United States Patent [19]

Jammet

[11] Patent Number: 5,004,435

[45] Date of Patent: Apr. 2, 1991

[54] MULTIPLE SOCKET ATTACHMENT

[76] Inventor: Jean-Claude Jammet, 4237 Louis Payette, Chomedey, Laval, Québec, Canada, H7T 4Y2

[21] Appl. No.: 457,102

[22] Filed: Dec. 26, 1989

[51] Int. Cl.[5] ..... H01R 13/00

[52] U.S. Cl. ..... 439/652

[58] Field of Search ..... 439/651, 652

[56] References Cited

U.S. PATENT DOCUMENTS

| | | | |
|---|---|---|---|
| 1,568,156 | 1/1926 | Herskovitz | 439/652 |
| 2,500,987 | 3/1950 | Harpster | 439/652 |
| 2,792,557 | 5/1957 | Dowick | 439/652 |
| 3,005,179 | 10/1961 | Holt | 439/652 |
| 3,997,225 | 12/1976 | Horwinski | 439/652 |

*Primary Examiner*—Joseph H. McGlynn
*Attorney, Agent, or Firm*—R. L. Morneau

[57] ABSTRACT

A multiple socket attachment adapted to be inserted in a conventional wall outlet and to laterally receive prongs of appliance cord plug having a pair of transversal, parallel, conductive strips separated by insulating walls. Each strip is conductively connected to an L-shaped prong extending outside the attachment. The prongs are disposed on each side of the longitudinal axis of the attachment and suitably spaced to fit the wall outlet. The strips have lateral abutments to prevent translation movement and a clip member at each end to receive the prongs from the cord plugs.

8 Claims, 4 Drawing Sheets

MULTIPLE SOCKET ATTACHMENT

BACKGROUND OF THE INVENTION

1. Field of the Invention:

This invention relates to electrical connection devices and more particularly to an outlet plug adapted to be mounted in an electrical wall outlet and into which a plurality of the electrical cords of appliances may be connected in planes at right angles to the plane of the wall outlet.

2. Prior Art:

Conventional electric service outlets installed in the walls are usually provided with a pair of double-pronged electric sockets. These sockets are adapted to receive the prongs known as contact fingers of appliance cord plugs in order to connect the appliances to the source of electricity. Since the number of common household appliances has considerably increased in recent years, the two sockets found in conventional wall outlets are often insufficient to fill the needs.

It has thus become common practice to utilize multiple socket attachments having a pair of main prongs receivable in the sockets of the wall outlet and which are electrically connected to the multiple sockets of the attachment into which appliance cords are insertable.

Most of these attachments have their multiple sockets located at the outer face of the casing, the plugged-in appliance cords thus projecting from the casing at a direction, normal or nearly normal, to the wall of the room.

Because of the inherent thickness of the multiple socket attachments, the plugging of multiple appliance cords results in an unsightly display. Furthermore, since the appliance cords extend in loops from the sockets, furniture which is often positioned in front of electrical wall outlets to hide their unesthetical aspects, must be placed at a substantial distance from the wall.

In addition, since the appliance cords project at right angles from the multiple socket attachments, that is, parallel to the main prongs, attempts at pulling out a cord from the assembly could easily result in inadvertent removal of the entire assembly from the wall outlet.

To circumvent the above-mentioned disadvantages, various multiple socket attachment, having their sockets at right angles to the plane of the main plug-in prongs and thus parallel to the plane of the wall have been developped.

Examples of such devices are disclosed in U.S. Pat. Nos. 2,761,113, 3,005,179, 3,061,716 and 3,156,515. The above-mentioned multiple socket attachments however present inherent structural deficiencies which tends to render them either potentially unsafe or relatively expensive to manufactures.

U.S. Pat. No. 2,761,113 discloses a multiple socket attachment which comprises a pair of rectangular plates each having a horizontal, longitudinally extending groove provided with vertical branches extending downwardly therefrom to the bottom of the plate. The mating vertical portions form sockets for receiving the prongs of appliance cords endplugs. Bus bars having depending legs are disposed in the fork-shaped grooves, the lower ends of the legs providing contact fingers. The bus bars also have integral strips which project at right angles outwardly through the back plate to serve as the main prongs.

When the plates, with their respective bus bars are joined with their respective front and rearward faces, an insulator strip must be interposed therebetween. This insulator strip is necessary in order to prevent electrical flashing or short circuiting. The patent is silent on the type of insulator strip, whether it is permanent or removable.

However, if a permanent strip, formed integrally with one of the plates is used, this will considerably complicate the molds required to manufacture the plates and will also render positioning of the bus bar into the plate more difficult during assembly.

On the other hand, if a removable type of insulator strip is used, the latter could be displaced due to the slackening of the link keeping the plates together or following a shock imparted on the device. The removable insulator strip could also be misplaced or totally omitted during assembly. Any of these situations could lead to the potential dangers resulting from electrical short circuiting of the buses.

U.S. Pat. No. 3,005,179 discloses a multiple socket attachment, wherein the symmetrical sections interlock with one another. Each section comprises partition walls defining spring contact cavities. A number of units comprising spring contacts and a prong are positioned inside each section. Even though each spring contact has its own cavity, when the sections are assembled toghether, the metal strips which interconnect the spring contacts in each section overlap each other, again creating a potential hazard for electrical flashing or short circuiting.

Furthermore, the units, because of their specific configuration, require folding operations in two separate planes during the manufacturing process.

U.S. Pat. No. 3,061,716 discloses an electro-luminescent night light combined with a multiple socket attachment. The invention comprises, amongst other components, a pair of contact strips maintained in criss-cross diagonal spaced relationship on the base of the attachment. The contact between the strips is avoided by cutting away the crossing portion. Again, a potential hazard resulting from short circuiting or flashing is inherent in the structure.

U.S. Pat. No. 3,156,515 discloses a multiple socket attachment in which the conductor strips are identically formed out of an elongated strip of material which is bent to provide three contact prong portions. Between the contact prong portions, the strip is structurally twisted so that the twisted portion is at an angle to the contact portion. The conductive strips override each other at their structurally twisted position thus again creating an electrical hazard.

Furthermore, because of the specific shape of the twisted conductive strips, the multiple plug attachments are inherently thick, thus increasing the spacing between the walls and the electrical cord appliance plug.

All of the above-mentioned patents disclose multiple socket attachments whereby the conductive material linking the sockets to the prongs are not fully surrounded by insulating material, thus creating potential hazards.

Accordingly, the present invention relates to a multiple socket attachment having its socket at right angles to the plane of the main plug-in prongs, wherein the conductive strips linking the sockets to the main plug in prongs are adequately insulated in order to prevent electrical short-circuiting or flashing.

The present invention further relates to a multiple socket attachment, in accordance with the previous object, whereby the conductive strips linking the sockets to the main plug-in prongs are identically formed during a simple and inexpensive manufacturing process. The insulating structure surrounding said strip will also be manufactured at a relatively low cost preferably by an injection moulding process.

SUMMARY OF THE INVENTION

According to the preferred embodiment of the invention, the multiple socket attachment has a rectangular base plate from which two longitudinal ledges and two transversal ledges extend perpendicularly. Two insulating units are positioned on the base plate. Each of said unit comprises a pair of adjacent substantially identical transversal sections, each of said sections comprises a substantially flat wall extending between the two longitudinal ledges. An irregular wall also extends between the two longitudinal ledges, both of said walls together defining a transversal insulating channel.

The irregular wall defines a longitudinal insulating channel which is off-center from the central longitudinal axis of the base plate and extends from the transversal insulating channels towards the irregular wall of the adjacent transversal section.

The base plate is provided with a slot aligned with each of the longitudinal insulating channels. The base plate, the ledges and the walls are made of insulating material. A pair of conductive strips extends inside the transversal insulating channels between the longitudinal ledges. Each conductive strip has a spring clip at each end. Each spring clip faces an aperture in the longitudinal ledges. A pair of prongs are electrically linked to each of the conductive strips and extend through one of the slots. The prongs are adapted to be inserted in a conventional electrical wall outlet and the conductive strips electrically link the prong to the clip. The spring clips are adapted to receive the prongs of appliance cord plugs and to provide electrical current to these plugs.

According to one embodiment of the invention, the spring clips are formed of a pair of resiliently abutting leaves longitudinally disposed relative to the strip, each of the leaves spreading outwardly adjacent the ledge.

The irregular walls have ledges and the conductive strips have corresponding adjacent ledges adapted to abut against the ledges of the irregular wall in order to prevent translation of the strip inside the transversal insulating channel.

According to the same embodiment, the multiple socket attachment can further comprise two transversal ledges extending perpendicularly from the base plate and a cover which is removably locked in abutting relationship with the longitudinal and transversal ledges.

Each of the unit is made up of two relatively identical sections. The longitudinal channel, the prong, the slot and the apertures in the longitudinal ledges of one of these sections are larger than the prong, the slot and the apertures in the longitudinal ledges of the adjacent section, in order to accomodate the larger prong of the electrical appliance cord socket which is used to ground the appliance.

According to one embodiment of the invention, a cover is provided with external protruding stoppers which are positioned adjacent each of the apertures in the longitudinal ledges and in a symetrical relationship. The stoppers are adapted to prevent insertion of a plug having a third grounding prong.

An alternative embodiment of the invention is characterized by the insertion of a grounding prong member fitted in the cover. The grounding prong member has three tubular members, two of which extend in cavities provided in the stoppers and a third one adjacent each pair of prongs for fitting into wall outlets.

DETAILED DESCRIPTION OF THE PREFERRED EMBODIMENT

Figure 1:
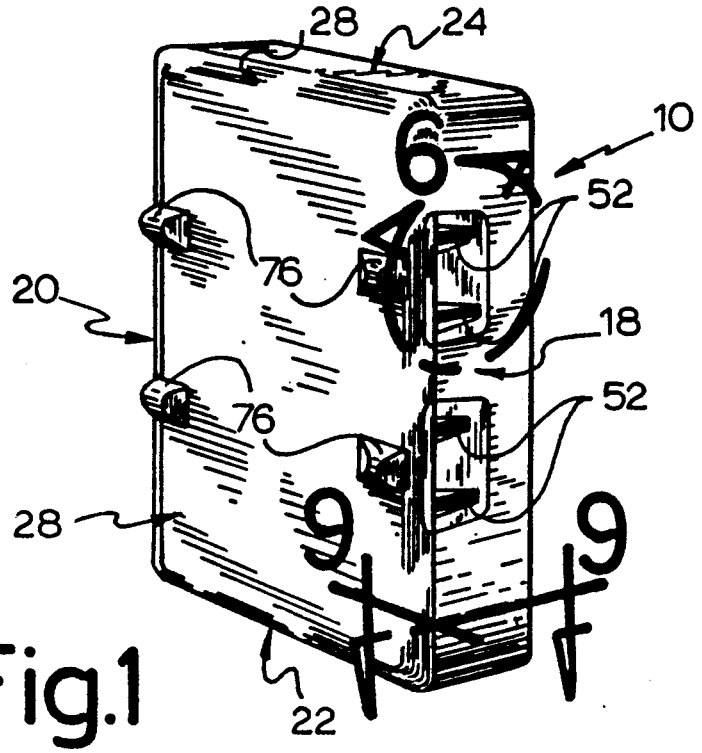
FIG. 1: is a front perspective view of the multiple socket attachment according to the invention.
Figure 2:
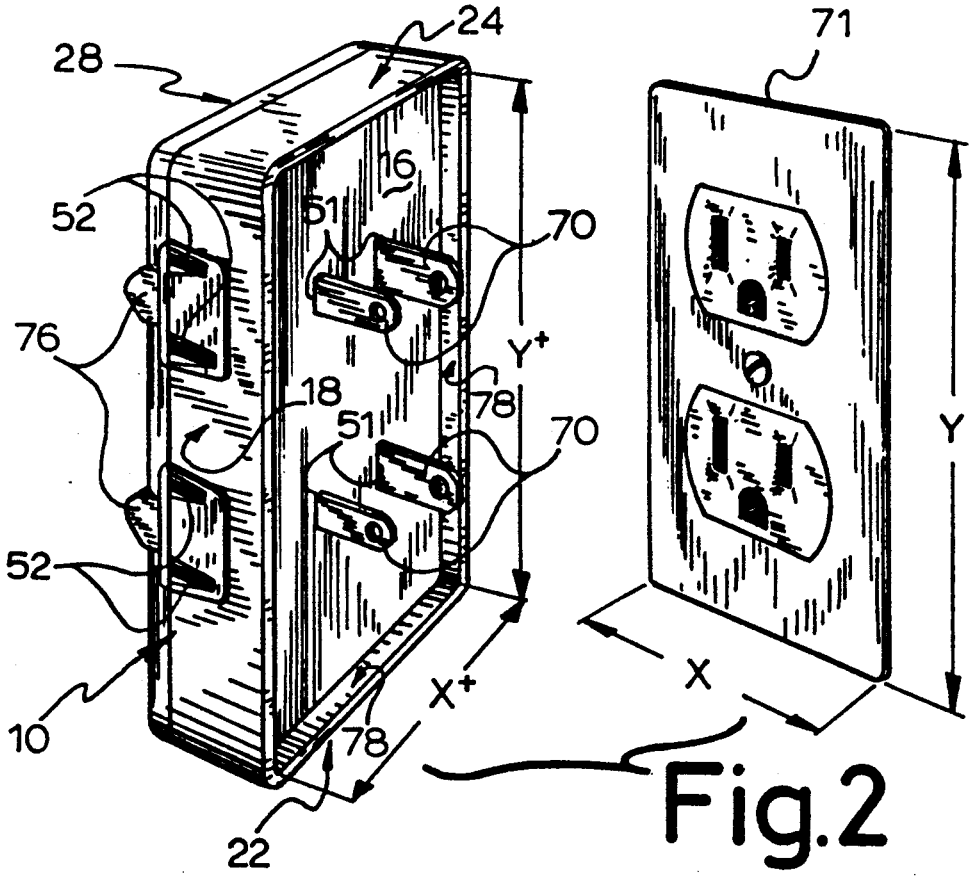
FIG. 2: is a rear perspective view of the attachment shown FIG. 1 separated from an electrical wall outlet.

Referring to the drawings, the multiple socket attachment is generally indicated by the reference numeral 10. Attachment 10 comprises a base plate 12 having a front side 14 and a back side 16 (FIG. 2). A pair of longitudinal ledges 18 and 20 and a pair of transversal ledges 22 and 24 extend perpendicularly from the front face 14 of the base plate 12 thus defining a cavity 26.

A cover 28 is releasably locked in abutting relation with the ledges 18, 20, 22 and 24 by a set of resilient locking prongs 30 which are adapted to snap into a set of corresponding locking notches 32 provided in the lateral ledges 18 and 20.

Two identical guiding and insulating housing units 34 adapted to safely retain a pair of substantially rectilinear electrically conductive elements 36 are positioned inside the cavity 26. Each of the two housing units 34 comprise two relatively identical sections 38.

Figure 8:
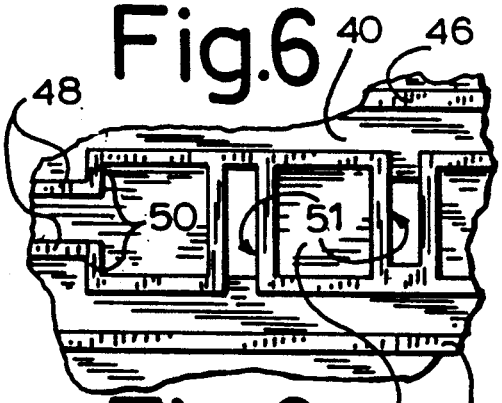
FIG. 8: is an enlarged representation of a front view of a portion of the walls and channels shown in FIG. 3.
Figure 9:
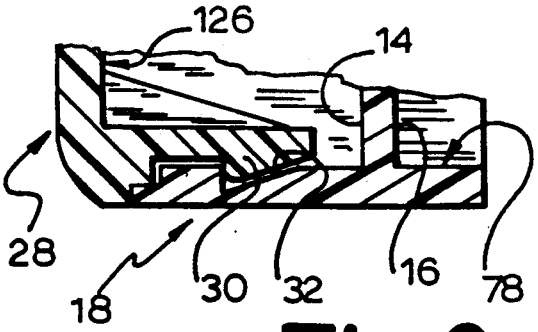
FIG. 9: is a cross-sectional view taken along line 9—9 of FIG. 1.

Each of the two sections 38 comprises a transversal insulating channel 40 extending between the lateral ledges 18, 20, and a longitudinal channel 42 extending perpendicularly from said transversal insulated channels, out of center from a central longitudinal axis 44 of the base plate 12. The transversal insulated channels 40 of each section 38 is defined by a flat wall 46 extending integrally from the front side 14 of the base plate 12 and a transversal symetrical irregular wall 48 projecting upwardly from the front side 14 of the base plate 12. Each irregular wall 48 has a pair of transversal ledges 50. The longitudinal channels 42 are defined by the irregular wall 48. The base plate 12 is provided with slots 51 aligned with each one of the longitudinal channels 42 (see FIG. 8). The lateral ledges 18 and 20 are provided with slots 52 aligned with each extremity of the transversal insulating channels 40. The conductive elements 36 comprise a conductive strip 54 having a spring clip 56 at each end, in register with the slots 52, and a perpendicular connecting portion 58 adapted to abut against the flat wall 46. The conductive strips 54 are provided with protrusions 62 adjacent to both extremities and adapted to abut against the transversal ledges 50 of the irregular wall 48 thus preventing transversal translation of the conductive elements 36. The spring clips 56 are formed of a pair of resiliently abutting leaves 64 longitudinally disposed relative to the strips 54, each of the leaves 64 spreading outwardly adjacent the ledges 18 and 20. The leaves 64 are adapted to resiliently and frictionally retain prongs of commonly known plugs of an electrical appliance cords 4.

An important feature of the present invention results from the fact that the conductive elements 36 are identically formed and are paired in substantially parallel relationship. Furthermore, the specific shape of the conductive strip 54 and the spring clips 56 allows them to be manufactured from a simple punch and die process followed by a folding operation in a single plane.

A set of conductive prongs 70 extending from the longitudinal channels 42 outwardly through the slots 51 in the base plate 12 are electrically linked to the conductive strips 54. The prongs 70 are made out of a substantially L-shaped piece of metallic material having a contact portion 72 bent and rigidly fixed to the connecting portion 58 of the strip 54 by welding spots 74 or other suitable means. The prongs 70 are adapted to be inserted into known electric sockets of the conventional wall service outlets.

Two basic systems are conventionally used for electrically grounding most conventional household appliances. According to the first of these two systems, the electrical wall outlet has sockets comprising only two openings, adapted to receive two corresponding contact prongs of appliance cord plugs. One of these openings and its corresponding contact prong is substantially larger than the other, thus allowing insertion of the prongs into the openings only when the plug is in a given orientation. This practice allows for electrical grounding of one of the two current supplying wires bringing current to the spring contacts located inside the openings of the wall outlet. The wire bringing current to the spring contacts in register with the larger opening is conventionally used for grounding purposes. The prongs are usually referred to as being polarized. The third opening leads to a contact which is electrically linked to a grounding wire.

The invention described so far is adapted for situations where the first type of grounding system is used. Accordingly, each housing unit 34 has one of its two transversal insulating channels 42 and its associated slot 51 larger than the other. Furthermore, the associated prong 70 is also larger than the prong located in the adjacent vertical insulated channel. The slots 52 and the the spring clip 56 to which the larger prong 70 is electrically connected by the associated conductive strip 36 are also larger than the same components in the other section 38 of the unit 34. This construction allows the largest of the two prongs of the known appliance cord plug to be electrically linked to the largest of the two prongs 70 and thus to be inserted in the largest of the two openings in the wall outlet 71 shown in FIG. 2.

In order to prevent users having appliances equipped with plugs having a third grounding prong and thus adapted to be used with the second system from hazardously using the attachment plug 10, a set of protruding stoppers 76 are formed integral with the cover 28. The stoppers 76 are adapted to prevent insertion of the electrical cord appliance plug having a third grounding prong and thus prevent insertion of the latter plug in the attachment 10. Furthermore, a protective skirt 78 adapted to encircle the conventional wall outlet plate 71 extends from the back side 16 of the base plate 12 in order to prevent the same users from partially inserting the attachment plug 10 in the wall outlet and inserting the third grounding prong 80 between the wall outlet and the back side 16 of the plate 12. The protective skirt 78 is dimensioned to surround the X and Y dimensions of the wall plate 71.

The invention described so far is adapted for situations where the previously mentioned first type of grounding system is used. A second embodiment of the invention is specifically adapted for use with plugs having a third grounding prong.

In order to prevent the overlapping section 104 of the long connecting prong 96 from coming in close relation with the conductive element 94 to which the short connecting prong 100 is welded, an insulating component 116 having an insulating flap 118 is positioned inside a recess 120 of the unit 92.

It is within the embodiment of the present invention that the multiple socket attachment 10 may have only one unit 34 and may be adapted to be electrically joined to only one of the sockets of the wall outlet.

Figure 3:
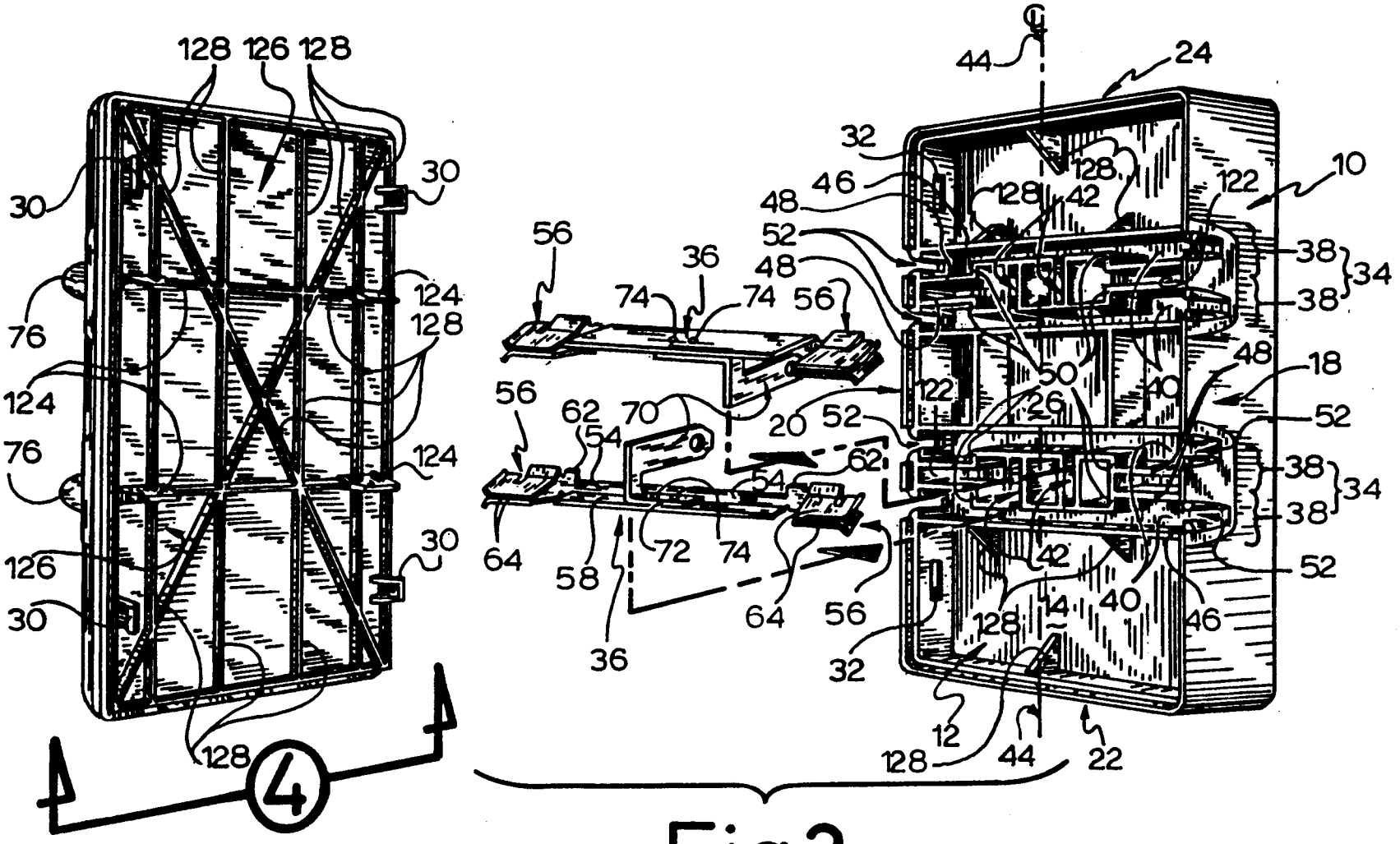
FIG. 3: is an exploded view of the attachment shown in FIG. 1.
Figure 4:
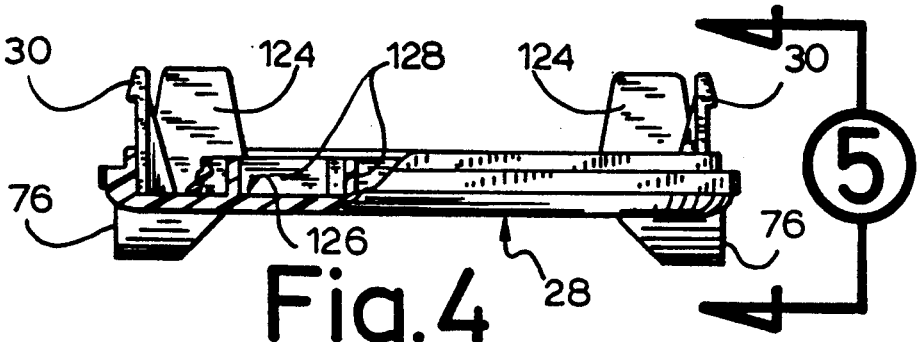
FIG. 4: is a bottom view of the cover of the attachment seen in the direction of the arrow 4 in FIG. 3.
Figure 5:
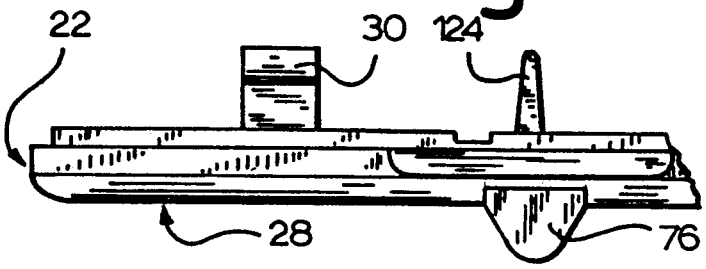
FIG. 5: is a portion of the side of the cover as seen in the direction of the arrow 5 in FIG. 4.
Figure 6:
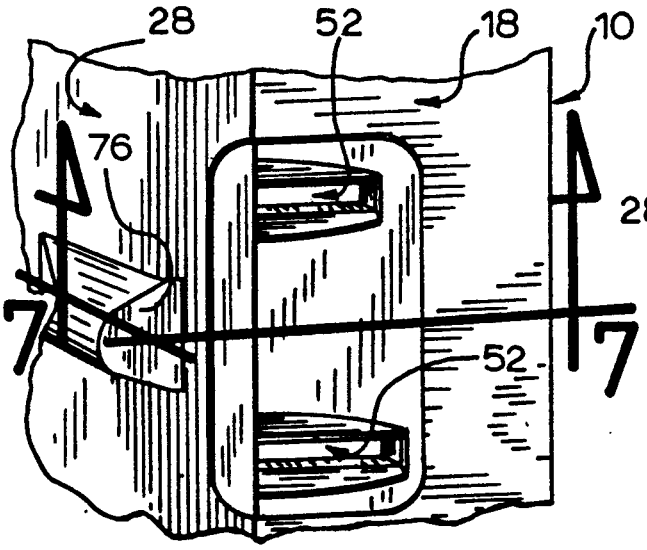
FIG. 6: is an enlarged representation of a portion of the attachment encircle by arrow 6 in FIG. 1.
Figure 7:
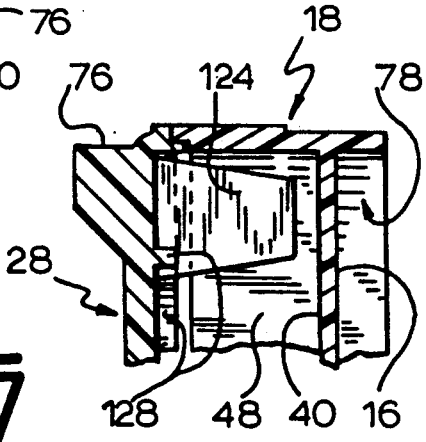
FIG. 7: is a cross-sectional view taken along line 7—7 of FIG. 6.

FIGS. 3 and 7 illustrate units 34 having an internal spacing 122 between two adjacent irregular walls 48. These spacings 122 are used in conjunction with a set of positioning prongs 124 provided on the inner side 126 of the cover 28 to facilitate the positioning of the cover 28.

A plurality of reinforcement ribs 129 on the inner side 126 of the cover 28 and on the front side 14 of the base plate 12, are provided to increase the structural rigidity of the socket attachment.

With the exception of the conductive elements 36 and the associated prongs 70, all components are made of non-conductive material such as polymeric resins.

Another embodiment of the invention is illustrated in FIGS. 10–13 in which a grounding prong member is added for allowing the suitable connection between a corresponding electrical wall outlet and a matching plug of an electrical cord.

Figure 10:
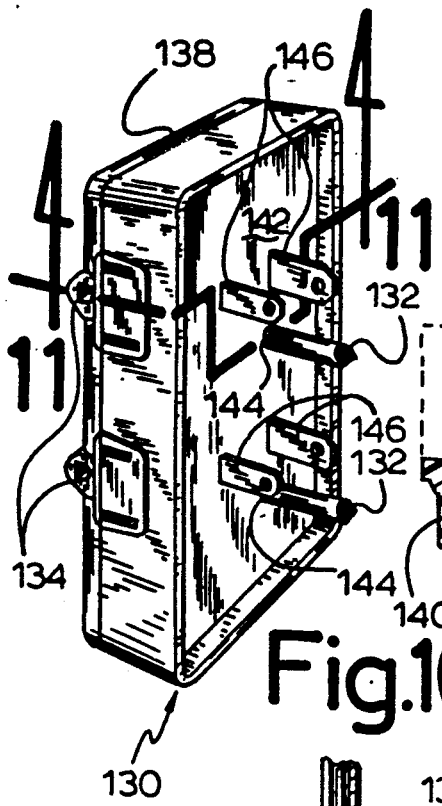
FIG. 10: is a perspective rear view of an alternative embodiment of the attachment according to the invention.

FIG. 10 illustrates a socket attachment 130 of the type shown in FIG. 2 but which is provided with grounding prongs 132 and cavities 134 for allowing the penetration of the third grounding prongs of known electrical cords.

Figure 11:
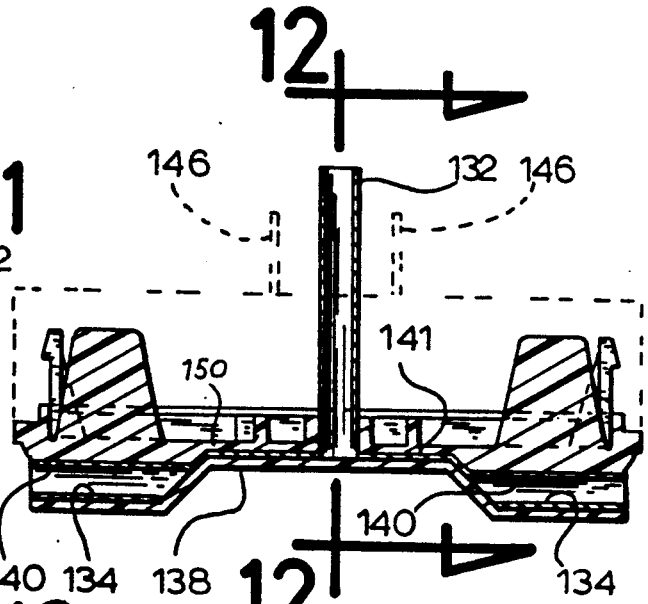
FIG. 11: is a cross-sectional view along line 11—11 of FIG. 10.
Figure 12:
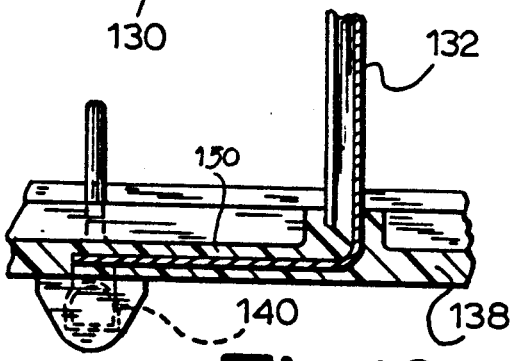
FIG. 12: is a cross-sectional view along line 12—12 of FIG. 11.
Figure 13:
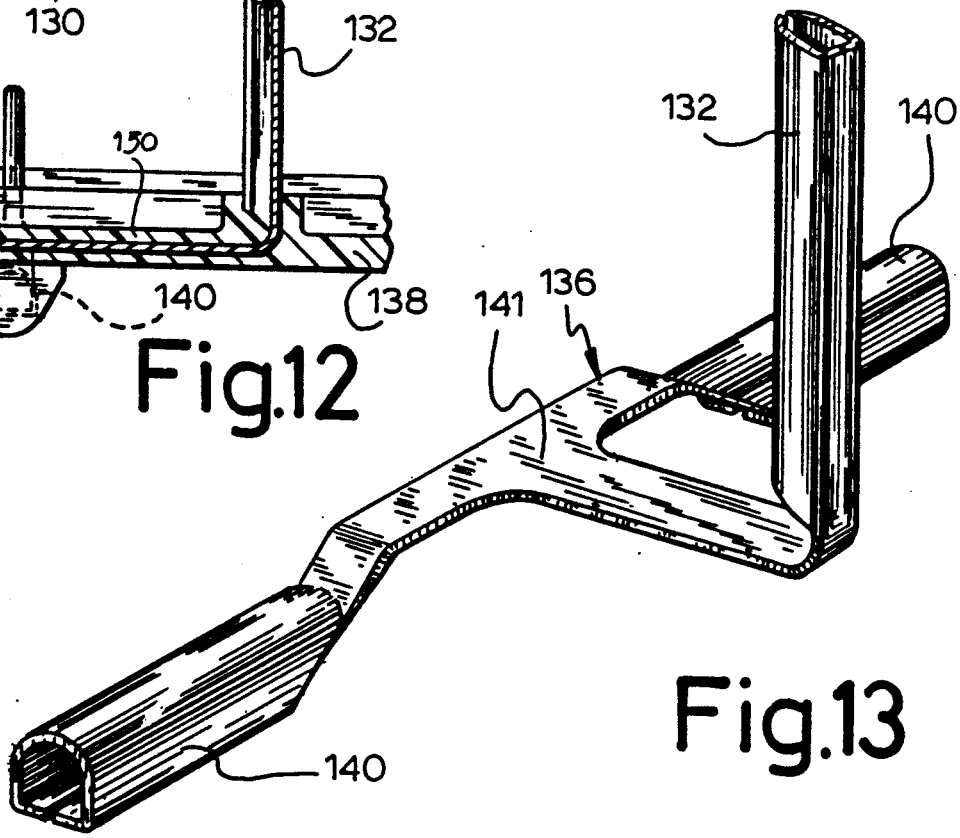
FIG. 13: is a perspective view of the third prong member as illustrated in FIG. 10–12.

The grounding prong member 136, as illustrated in FIG. 13, is inserted in the cover 138 as shown in FIGS. 11 and 12. The prong member 136 is made from a sheet of metal having a generally cross-shape design, the end of which are folded in tubular members 140 to fit the cavities 134 and as a prong 132 to suitably fit, at the other end into wall outlets.

The base plate 142 is provided with a pair of apertures 144 suitably located relative to the prongs 146. When the cover 138 is mounted to close the attachment 130, the prongs 132 automatically penetrate into the apertures 144 of the base plate 142. The cover 138 is locked in a similar manner as explained in FIGS. 1–9.

The cover 138 is preferably made with interal grooves and ribs 150 which match the contour of the prong member 136 and in particular the tubular members 140 and the inter-connecting strip 141.

I claim:

1. A multiple socket attachment adapted to be inserted in a conventional electric wall outlet for electrically bridging the wall outlet and the prongs of an appliance cord plug, said attachment comprising:

a rectangular base plate having a central longitudinal axis;

two lateral ledges parallel to said axis extending perpendicularly from said base plate on one side thereof;

at least one insulating unit longitudinally extending from one of said ledges to the other, each of said unit comprising:

a pair of adjacent parallel and substantially identical transversal sections, each of said sections comprising:

a flat wall extending between said two lateral ledges, the flat walls of said pair of sections being parallel;

an irregular wall parallel to said flat wall also extending between said two lateral ledges; the irregular walls of said pair of sections being located between said flat walls for defining two parallel transversal insulating channels; each of said irregular walls defining a longitudinal insulating channel, off-center from said central longitudinal axis of said base plate and extending from said transversal insulating channel towards said irregular wall of said adjacent transversal section, said base plate having a slot therethrough in line with each of said longitudinal insulating channels;

said base plate, said lateral ledges, said flat walls and said irregular walls being made of insulating material.

a pair of linear conductive strips, each of said strips extending edgewise inside said transversal insulating channels between said lateral ledges, and having a spring clip at each end, each of said clips facing an aperture in said lateral ledges for gripping one of said prongs of said appliance cord plug; and a pair of L-shaped prongs, each of said L-shaped prongs being electrically linked to each of said conductive strips, said L-shaped prongs being secured to said strip at 90° therewith and extending on the opposite side of said base plate through one of said slots, whereby said L-shaped prongs are adapted to be inserted in said conventional electrical wall outlet and said conductive strips electrically link said L-shaped prongs to said spring clips, said spring clips being adapted to receive said prongs of said appliance cord plugs for providing electrical current.

2. A multiple socket attachment as recited in claim 1 wherein said strip has a flange disposed flatwise on said base plate in said channel, each of said spring clips is formed of a pair of resiliently abutting leaves spreading outwardly adjacent said ledges in a plane corresponding to said linear strip.

3. A multiple socket attachment as recited in claim 1, wherein said irregular walls have transversal ledges and said conductive strips have corresponding adjacent protrusions adapted to abut against said transversal ledges of said irregular wall in order to prevent translation of said strip inside said transversal insulating channel.

4. A multiple socket attachment as recited in claim 1, comprising a cover removably locked in abutting relationship with said said cover being provided with protruding stoppers positioned adjacent each of said apertures on said base plate on the side opposite said lateral ledges and between said apertures, said stopper being adapted to prevent insertion of a plug having a third grounding prong.

5. A multiple socket attachment as recited in claim 1, wherein one of the L-shaped prongs, slots, and apertures in each pair of said L-shaped prongs, of said slots and of said apertures is larger than the other L-shaped prong, slot and aperture in said pair of L-shaped prongs, slots and apertures, said attachement being adapted to be polarized.

6. A multiple socket attachment as recited in claim 5, wherein said multiple socket attachment further comprises a protective skirt extending peripherally from said base plate in a direction opposite said lateral ledges, said protective skirt adapted to surround said electric wall outlet.

7. A multiple socket attachment as recited in claim 5, wherein each of said stopper is provided with a tubular cavity extending inside said attachment, and said base plate is provided with a perforation adjacent said slots, said attachment comprising a grounding prong member fixed to said cover, said prong member having three hollow prongs conductively connected to each other through a cross-shaped strip, two of said hollow prongs extending in said cavities and the other of said grounding prongs outwardly extend from said base plate through said perforation.

8. A multiple socket attachment as recited in claim 7, wherein said cover is provided with grooves and ribs for securing said cross-shaped strip of said grounding prong member.

* * * * *